US007641083B2

(12) United States Patent
Goldman et al.

(10) Patent No.: US 7,641,083 B2
(45) Date of Patent: Jan. 5, 2010

(54) GARMENT HANGER WITH TOP SIZER

(75) Inventors: Stuart Goldman, Wayne, NJ (US); King Keung Kennedy Chan, Hong Kong (HK)

(73) Assignee: Uniplast Industries, Inc., Hasbrouck Heights, NJ (US)

( * ) Notice: Subject to any disclaimer, the term of this patent is extended or adjusted under 35 U.S.C. 154(b) by 0 days.

(21) Appl. No.: 12/131,244

(22) Filed: Jun. 2, 2008

(65) Prior Publication Data

US 2009/0294492 A1 Dec. 3, 2009

(51) Int. Cl.
*A41D 27/22* (2006.01)

(52) U.S. Cl. ..... 223/85; 40/322

(58) Field of Classification Search ..... 223/85, 223/88; 40/322; D6/328
See application file for complete search history.

(56) References Cited

U.S. PATENT DOCUMENTS

| | | | | | |
|---|---|---|---|---|---|
| 5,503,310 | A * | 4/1996 | Zuckerman et al. | ..... | 223/85 |
| 5,590,822 | A * | 1/1997 | Zuckerman | ..... | 223/85 |
| 5,603,437 | A * | 2/1997 | Zuckerman | ..... | 223/85 |
| 5,687,887 | A * | 11/1997 | Bond et al. | ..... | 223/85 |
| 5,775,553 | A * | 7/1998 | Marshall et al. | ..... | 223/85 |
| 5,794,363 | A * | 8/1998 | Marshall et al. | ..... | 40/322 |
| D441,823 | S | 5/2001 | Blackhurst | | |
| 6,726,067 | B2 * | 4/2004 | Louw | ..... | 223/85 |
| D510,198 | S | 10/2005 | Willardson | | |
| D528,807 | S | 9/2006 | Mainetti | | |
| D536,180 | S | 2/2007 | Wu | | |
| D536,181 | S | 2/2007 | Wu | | |
| D547,557 | S | 7/2007 | Wu | | |
| 7,240,813 | B1 | 7/2007 | Goldman | | |
| D552,361 | S | 10/2007 | Goldman | | |
| 7,278,558 | B1 * | 10/2007 | Sutton et al. | ..... | 223/85 |
| D554,378 | S | 11/2007 | Niederer | | |
| 7,303,101 | B2 | 12/2007 | Goldman | | |
| 7,380,359 | B2 * | 6/2008 | Mainetti | ..... | 40/322 |
| 2002/0184799 | A1 * | 12/2002 | Chou | ..... | 40/322 |
| 2003/0173381 | A1 * | 9/2003 | Louw | ..... | 223/85 |
| 2004/0181986 | A1 * | 9/2004 | Mainetti | ..... | 40/625 |
| 2006/0049222 | A1 * | 3/2006 | Pluchino et al. | ..... | 223/85 |

* cited by examiner

*Primary Examiner*—Gary L Welch
*Assistant Examiner*—Nathan E Durham
(74) *Attorney, Agent, or Firm*—Leason Ellis LLP

(57) ABSTRACT

A garment hanger for use with a top sizer clip that has locking tabs formed along an interior thereof includes a body having a hook member including a web portion and a platform extending at least partially around the web portion. The web portion has a first surface, an opposing second surface, and a pair of locking apertures for receiving the locking tabs to securely attach the top sizer clip to hanger. The web portion has at least one beveled cam surface that includes a first edge that defines an entrance into an adjacent locking aperture and an opposite second edge that interfaces with the first surface for allowing the top sizer clip to be moved to an unlocking position.

18 Claims, 2 Drawing Sheets

GARMENT HANGER WITH TOP SIZER

TECHNICAL FIELD

The present invention relates to a garment hanger of the type which includes a locking information clip and more particularly, to a top sizer clip for use with the garment hanger.

BACKGROUND

There are a number of different types of garment hangers that are used to hold a number of different articles of clothing or other types of articles, such as linens or other household fabrics. Typically, garment hangers are either formed of a plastic material or a metal material or a combination thereof. Not only do garment hangers come in a variety of different sizes but they also come in a number of different styles that have different types of constructions to accommodate different articles that are carried by the hangers.

For example, one type of garment hanger construction is designed to secure knitwear, blouses, slips, strapped garments, including dresses and lingerie. Another type of garment hanger construction is designed to also secure blouses, dresses and other light garments, while another type of garment hanger is designed to secure heavier knitwear, blouses, pants and light weight pant suits. Yet another type of garment hanger is designed to secure coats, jackets and outerwear. The foregoing types of garment hangers can be generally classified as being top garment hangers, while another class of garment hangers is pant hangers, which are those hangers that are designed to secure pants, skirts, and other outfits together. Often times, pant hangers incorporate some type of clamp mechanism to securely grasp and hold the articles of clothing. One will appreciate that there are even more types of garment hangers (e.g., bra/panty hanger) that are intended for particular applications.

One accessory that is often used with a hanger is a size indicator that typically is a small plastic part that attaches to the body of the hanger and has indicia formed thereon that indicates the size or some other identifying mark of the article of clothing that is being held on the hanger. The size indicator can either take the form of a side sizer, where the clip (sizer) attached to the side of a hook member or a top sizer, where the clip attaches more to the top of the hook member.

Conventional top sizer clips are most times custom designed for a specific type or style of hanger (i.e., a matching hanger) and therefore, when they are used with other hangers, the clips tend not to be secured to the hanger but instead either are too small so that they can not be received on the base structure or they are too large and therefore, they wobble on the base structure and can easily become disengaged and fall off the hanger. By not having a secure attachment between the clip and the hanger, the size indicators do not perform their full intended function and instead can easily become misplaced and replacement thereof can result in the wrong size indicator being placed on the hanger which in turn can result in the wrong article of clothing being selected by a consumer or if no size indicator is present, the consumer may rummage through the clothing and leave an untidy display in order to find the proper size.

However, there are certain instances, when it is desirable to have the ability to remove the top sizer clip from the hanger after it has been securely attached thereto. For example, the top sizer clips are reusable and therefore, they can be removed from one hanger and placed on another hanger. The ability to remove and reuse the top sizer clips reduces cost and reduces waste. However, as mentioned above, the top sizer clip should not be easily removable since this is undesirable and therefore, there is a need for a garment hanger/top sizer combination where the top sizer can be selectively removed.

SUMMARY

A garment hanger for use with a top sizer clip that has locking tabs formed along an interior thereof includes a body having a hook member including a web portion and a platform extending at least partially around the web portion. The web portion has a first surface, an opposing second surface, and a pair of locking apertures for receiving the locking tabs to securely attach the top sizer clip to hanger. The web portion has at least one beveled cam surface that includes a first edge that defines an entrance into an adjacent locking aperture and an opposite second edge that interfaces with the first surface for allowing the top sizer clip to be moved to an unlocking position.

A top sizer clip in combination with a hanger having a body and a hook member includes a top sizer clip body having a pair of side walls and end walls joined to and extending between the side walls. The top sizer body includes a top wall that is joined to upper edges of the side walls and end walls. The top wall partially encloses the body so as to create a hollow body structure that includes an interior compartment defined by the end walls, side walls, and top wall. An inner surface of at least one side wall includes at least one locking tab. The hook member is coupled to a base section of the hanger body and includes a web portion and a platform extending at least partially around the web portion. The web portion has a first surface, an opposing second surface, and at least one locking aperture for receiving the locking tab to securely attach the top sizer clip to hanger in a locked position which prevents removal of the top sizer clip from the hook member. The web portion has at least one beveled cam surface accessible along the first surface. The beveled cam surface includes a first edge that defines an entrance into the locking aperture and an opposite second edge that interfaces with the first surface and permits lateral movement of the top sizer clip on the web portion from the locked position to an unlocking position where the locking tab is displaced from the locking aperture by riding along the cam surface, thereby allowing the top sizer clip to be more easily removed from the hook member.

A method for locking a top sizer clip on a hook member of a garment hanger and then selectively removing the locked top sizer clip from the garment hanger hook member includes the steps of: (1) providing on the hook member a web portion and a platform extending at least partially around the web portion, the web portion having a first surface, an opposing second surface, and a pair of locking apertures; (2) forming a pair of beveled cam surfaces in the web portion, the cam surfaces being accessible along the first surface, each beveled cam surface including a first edge that defines an entrance into the locking aperture and an opposite second edge that interfaces with the first surface; (3) inserting the top sizer clip on the web portion such that the web portion is received into a hollow interior thereof, the top sizer clip having a pair of locking tabs formed along an inner surface of one side wall within the hollow interior, the locking tabs initially contacting the first surface of the web portion; (4) aligning the locking tabs with the locking apertures and directing the top sizer clip down along the first surface until the locking tabs are snap-lockingly received within respective locking apertures, thereby securely attaching the top sizer clip to the hook member in a locked position which prevents removal of the top sizer clip from the hook member; and (5) selectively moving the top sizer clip to an unlocking position when it is desired to remove the top sizer clip by laterally moving the top sizer clip along the platform causing the locking tabs to encounter and ride up along corresponding cam surfaces resulting in outward separation of side walls of the top sizer clip, thereby permitting the top sizer clip to then be lifted upwardly and removed from the web portion as the locking tabs rides along the first surface outside of the locking apertures and the cam surfaces.

Advantageously, a user can selectively remove the top sizer clip from the web portion by following a two step process, namely, a first step where the top sizer clip is moved laterally relative to the web portion (hook member) until an unlocking position is achieved and then a second step where the top sizer clip is moved vertically relative to the web portion to disengage the top sizer clip from the hook member.

Other features and advantages of the present invention will be apparent from the following detailed description when read in conjunction with the accompanying drawings.

BRIEF DESCRIPTION OF THE DRAWINGS FIGURES

The foregoing and other features of the present invention will be more readily apparent from the following detailed description and drawings figures of illustrative embodiments of the invention in which.

DETAILED DESCRIPTION OF EMBODIMENTS

Figure 1:
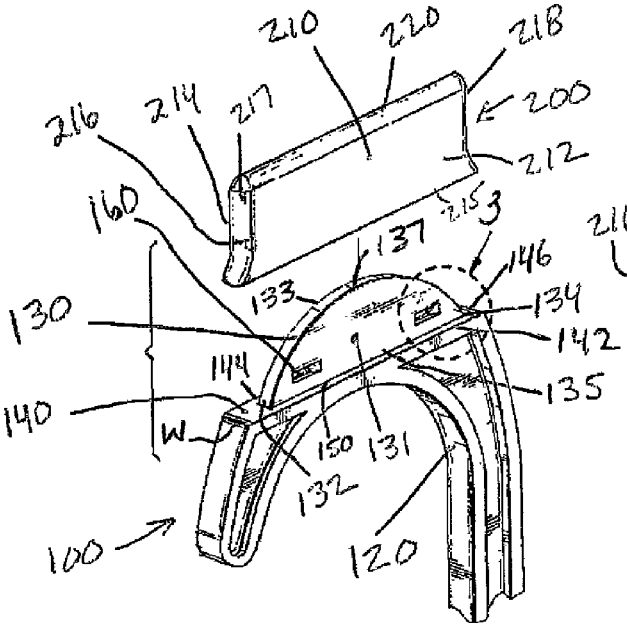
FIG. 1 is a local perspective view, partially broken away, of a hook of a garment hanger with a top sizer clip shown exploded therefrom according to the present invention.

FIG. 1 is a side perspective view of a portion of a garment hanger 100 that includes a body portion (not shown) having two opposing ends and a hook member 120 that is attached to the body portion. A top sizer clip (indicator) 200 according to the present invention is shown in an exploded manner relative to the hook member 120. As described below, the top sizer clip 200 is constructed to intimately engage and be securely, yet releasably, attached to a portion of the hook member 120. It will be appreciated that the garment hanger 100 can have any number of conventional constructions, including having a body portion that is of a flat bar type suitable for holding a top or the like. However, the garment hanger 100 can be of the type that includes a clamp or grip assembly formed near or at each of the first and second ends for holding a pant or the like. The grip assemblies can be integrally formed with the body portion at the first and second ends. It will be appreciated that the garment hanger 100 and/or the top sizer clip indicator 200 can be formed of either an opaque material or transparent material, etc.

The body portion of the garment hanger, including any grip assemblies and including the hook member 120, is preferably made as a single piece, molded in plastic using a plastic injection molding machine, as understood by those skilled in the art. Any appropriate plastic can be used, such as styrene, which provides a clear, virtually transparent hanger and alternatively, the hanger 100 can be molded using polypropylene, such as H.I. styrene polypropylene, polypropylene, polyvinylchloride, ABS or other suitable thermoplastics and/or mixtures thereof. As understood by those skilled in the art, the plastic mixture used to mold the hangers can include additional resins for added strength and reinforcement.

One exemplary type of garment hanger 100 is shown in commonly assigned U.S. design Pat. No. D453,423. This type of garment hanger 100 is commonly referred to as a bra and panty hanger.

As shown in FIG. 1, the illustrated garment hanger 100 is of a fixed hook type construction in that the hook member 120 for fixed attachment to the body portion at a location that is generally at a midpoint along the body portion. Unlike the hook member in the '423 patent, the hook member 120 of the garment hanger 100 is configured to receive and lockingly engage the top sizer clip 200. More specifically, the uppermost arcuate edge of a conventional rounded hook member 120 has been removed and modified to allow for reception and locking with the top sizer clip 200. Instead, the hook member 120 has a web 130 for removably securing the top sizer clip 200 to the garment hanger 100. The web 130 defines the topmost structure of the hook member 120.

As shown in FIGS. 1-5, the web 130 has different dimensions than the surrounding portions of the hook member 120. In particular, the hook member 120 has a platform 140 from which the web 130 extends upwardly. The platform 140 is planar in nature and has a length L defined by front and back edges 142, 144, respectively, and has a width or thickness W defined by a pair of opposing ends 146. The length L is greater than the width W. In addition, the width W is typically the same width as the remaining portions of the hook member 120. In the illustrated embodiment, the platform 140 is generally rectangular in shape; however, other shapes are equally possible so long as the top sizer clip 200 seats properly relative to the platform 140.

Figure 5:
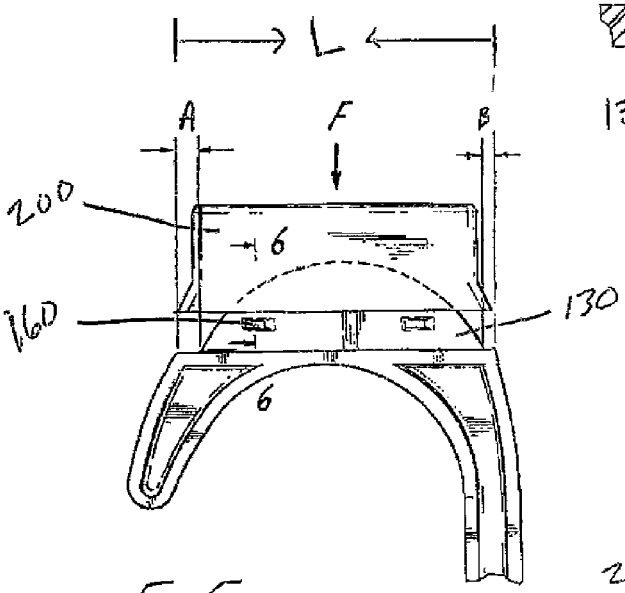
FIG. 5 is side elevation view of the garment hanger hook showing a first step of engaging the top sizer clip with the garment hanger hook.

The web 130 is disposed along the platform 140 such that it extends upwardly therefrom. In contrast to conventional design and for reasons described in detail below, the web 130 is not centered relative to the platform 140 but rather is formed in an off-centered position (in the left to right (lateral) direction) along the platform 140. As best shown in FIG. 5, a distance A is formed between a first end 132 of the web 130 and the end 146 of the platform 140 and a distance B is formed between an opposite second end 134 of the web 130 and the end 146 of the platform 140. The distance A is greater than the distance B, thus indicating the off-centered nature of the web 130. The web 130 has a first surface or face 131 that faces the front edge 142 of the platform 140 and an opposite second surface or face 133 that faces the rear edge 144 of the platform 140. The web 130 is preferably perpendicularly oriented relative to the top surface of the platform 140. A shoulder (e.g., right angled shoulder) is formed between the web 130 and the platform 140.

The web 130 itself can have any number of different shapes so long as the shape of the web 130 is complementary to the construction of the top sizer clip 200 to allow reception on and locking between the top sizer clip 200 and the web 130. In the illustrated embodiment, the web 130 has a crescent or semi-circular shape that includes the two ends 132, 134 and includes a top edge 136 that defines the topmost portion of the garment hanger 100. A height of the web 130 is defined as the distance between the top edge 136 at its apex and a bottom edge 135 of the web 130 at the interface between the web 130 and platform 140.

Unlike the off-centered nature of the web 130 in the lateral direction along the platform 140, the web 130 is preferably centered in the front-to-back direction on the platform 140. In other words, the distance between the first surface or face 131 of the web and the front edge 142 of the platform 140 and the distance between the second surface or face 133 and the rear edge 144 of the platform 140 is equal or about equal to one another. This arrangement is possible since the web 130 has a width or thickness that is less than the thickness of the platform 140.

A peripheral ledge 150 is thus formed around the web 130 for receiving the top sizer clip 200 as described below. The peripheral ledge 150 is thus an exposed planar portion of the platform 140 formed around the web 130.

Figure 3:
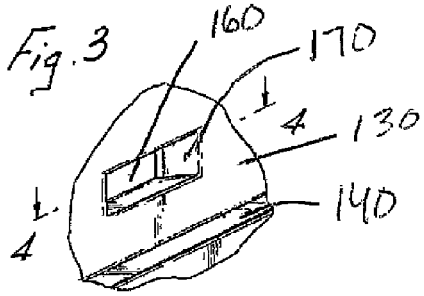
FIG. 3 is a local perspective view of a portion of the web of a locking portion of the hook of the garment hanger.
Figure 4:
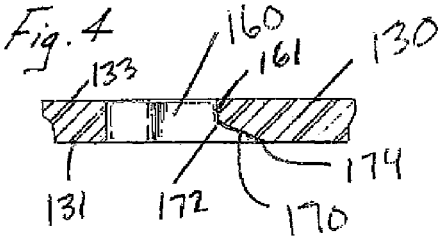
FIG. 4 is a cross-sectional view taken along the line 4-4 of FIG. 3.

In accordance with the present invention, besides being off-centered relative to the platform 140, the web 130 includes a pair of locking members 160 that permit the top sizer clip to be removably interlocked with the web 130. As shown in FIGS. 1, 3, and 4, the locking members 160 are in the form of a pair of locking apertures or openings (through holes) 160 that are formed in the web 130 and extend therethrough from the first surface 131 to the second surface 133. In one embodiment, the locking apertures 160 are evenly and uniformly formed in the web 130. In other words, the distance from each aperture 160 to the respect end 132, 134 is equal or about equal and the distance from each aperture 160 to the bottom edge 135 is equal or about equal. However, the locking apertures 160 can be formed in a non-uniform manner within the web 130. The illustrated locking apertures 160 have a square or rectangular shape; however, these shapes are merely exemplary and other shapes, such as oval or circular can also be used for the locking apertures 160.

Each locking aperture 160 includes a feature that, as described below in more detail, permits the top sizer clip 200 to be more easily removed when it is selectively moved along the web 130 to an unlocking position. More specifically, each locking aperture 160 includes a cam surface 170 that communicates and interfaces with the aperture 160. The cam surface 170 is in the form of a ramp or inclined surface that cooperates at one end with the locking aperture 160. As best shown in FIG. 4, the cam surface 170 has a first end 172 that intersects an inner wall 161 that defines the locking aperture 160 and has an opposite second end 174 that intersects the first surface or face 131 of the web 130. The cam surface 170 is a beveled surface in that it is angled relative to both the inner wall 161 and the first surface 131. The degree of the angle of the cam surface 170 can vary depending upon the particular application. However, the cam surface 170 can form an angle between about 20° and about 45° relative to the first surface 131 of the web 130 (alternatively, the angle can be between about 15° and about 30°). However, these numbers are merely for example only as it will be appreciated that the angle of the cam surface 170 can be greater than 45° in some applications.

The apertures 160 are axially aligned such that a central axis extending through the apertures 160 is at least substantially parallel to the top surface of the platform 140. The first end 172 of the cam surface 170 is formed so that is preferably formed at one end or side of the aperture 160. It is important to note that the cam surfaces 170 are not formed such that they directly face one another. As can be seen in FIG. 1, there is one cam aperture 160 between the two cam surfaces 170. In other words, the far right cam surface 170 directly faces the end 134, while the left cam surface 170 is positioned between the two apertures 160. The alignment and positioning of the cam surfaces 170 is such that the top sizer clip 200 can be moved laterally along the web 130 and the platform 140.

It will be appreciated that the illustrated embodiment only includes the cam surfaces 170 along the first surface 131 of the web 130; however, in another embodiment, the cam surfaces 170 can be formed also in the second surface 133 so as to provide cam surfaces 170 on both faces 131, 133 of the web 130.

Figure 2:
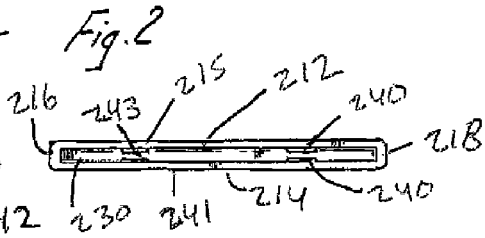
FIG. 2 is a bottom plan view of the top sizer clip of FIG. 1.

FIGS. 1-2 illustrate the top sizer clip 200 according to one embodiment of the present invention. The top sizer clip 200 is formed of a clip body 210 that is essentially hollow and is defined by a first side wall 212, an opposing second side wall 214, a first end wall 216, an opposing second end wall 218, and a top wall 220. The bottom of the top sizer clip 200 is open so as to permit the top sizer clip 200 to be inserted over the hook member 120 and then securely attached to the hanger 100 as described below.

While the top sizer clip 200 can be formed of any number of different materials, the clip 200 is typically made from a plastic material using conventional techniques, such as molding techniques, e.g., injection molding. The clip 200 can be either opaque in nature or semi-transparent or transparent and can be formed to have any number of different colors.

Each of the first and second side walls 212, 214 can have a substantially parallelogram shape in that top and bottom edges 213, 215, respectively, thereof are parallel and the two end walls 216, 218 join the side walls 212, 214 at an angle such that the ends are beveled walls with respect to a ground surface (bottom edge 215). In the illustrated embodiment, only a portion of each end walls 216, 218 is beveled, with the other portion being a vertical portion; however, it will be understood that the entire end wall 216, 218 can be beveled.

The end walls 216, 218 extend between the two side walls 212, 214 and are joined at their top edges 217 to the top wall 220. The end walls 216, 218 can have any number of different shapes. In the illustrated embodiment, the end walls 216, 218 have a rounded shape in that the outer edges thereof are rounded. The top edge 213 that joins the top wall 220 can likewise be rounded.

As best shown in FIG. 2, the body 210 of the top sizer clip 200 has an inner surface 230 and an opposing outer surface 241. The inner surface 230 of the clip 200 is partially defined by an inner face formed as part of each side wall 212, 214. Each inner face of each side wall 212, 214 includes a pair of attachment features 240 that facilitate the secure attachment of the top sizer clip 200 to the hanger 100, and more particularly, to the web 130 of the hook member 120.

Figure 6:
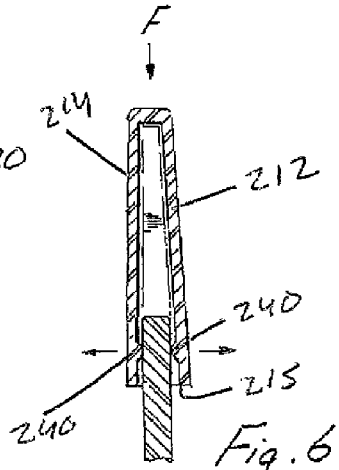
FIG. 6 is cross-sectional view taken along the line 6-6 of FIG. 5.

In one embodiment, the attachment feature is in the form of a pair of locking tabs or nubs 240 that are formed along the inner surface 240 and protrude or extend above the surrounding sections of the inner surface 240. The locking tabs 240 lie within a plane that is parallel to the bottom edges 215 of the clip 200. As shown in FIG. 6, the locking tabs 240 are positioned proximate to the bottom edges 215.

The locking tab 240 can have any number of different shapes; however, the size and shape of the locking tabs 240 are selected in view of the dimensions of the locking apertures 160 and the cam surfaces 170 to allow for reception of the locking tabs 240 into the apertures 160 and allow for the locking tabs 240 to ride along the cam surfaces 170. For example, the locking tabs 240 can be rounded bumps (as illustrated) or they can be square or rectangular shaped tabs or they can have other shapes. The shape and dimensions (e.g., height and length) of the inner cavity of the top sizer clip 200 are such that the web 130 can be received therein when the top sizer clip 200 is inserted onto the web 130 and locked in place.

The locking tabs 240 are formed so that a distance from the locking tabs 240 to the bottom edges 215 is about equal to the distance from the aperture 160 to the top surface of the platform 140. This allows the locking tabs 240 to engage the apertures 160 when the top sizer clip 200 is received on the web 130 and placed in the locked position shown in FIG. 9 and as described below. The locking tabs 240 are located opposite one another on the inner surfaces 240.

The process of securely attaching the top sizer clip 200 to the hanger 100 and more particularly, the web 130 of the hook member 120, is now described. As shown in FIGS. 5 and 6, the top sizer clip 200 is first aligned relative to the hanger 100 such that the bottom edge of the clip 200 and the interior thereof face and are located above the web 130 of the hook member 120. The locking tabs 240 of the top sizer clip 200 are first vertically aligned with the apertures 160 and as the web 130 is inserted into the interior of the top sizer clip 200, the locking tabs 240 engage the first and second faces 131, 133 of the web 130 and since the thickness of the web 130 is greater than the space 243 (FIG. 2) between the locking tabs 240 in a relaxed state of the clip 200, the side walls 212, 214 flex outwardly as shown by the arrows in FIG. 6. The top sizer clip 200 is then continually advanced toward the platform 140 resulting in the locking tabs 240 being driven toward the locking apertures 160 as shown by the arrow F in FIG. 5.

Figure 7:
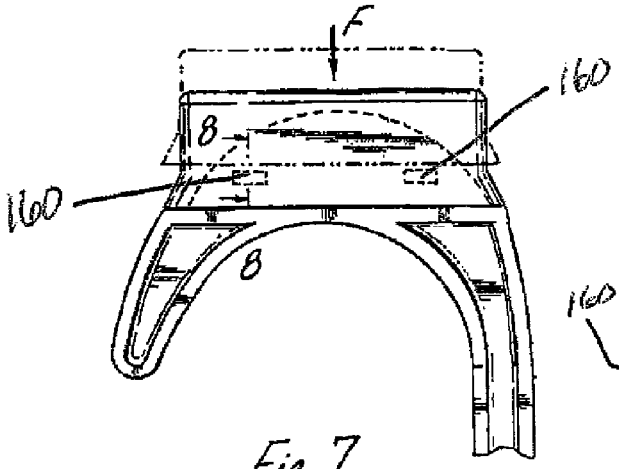
FIG. 7 is a side elevation view of the garment hanger hook showing the top sizer clip in an engaged position with respect to the garment hanger hook.
Figure 8:
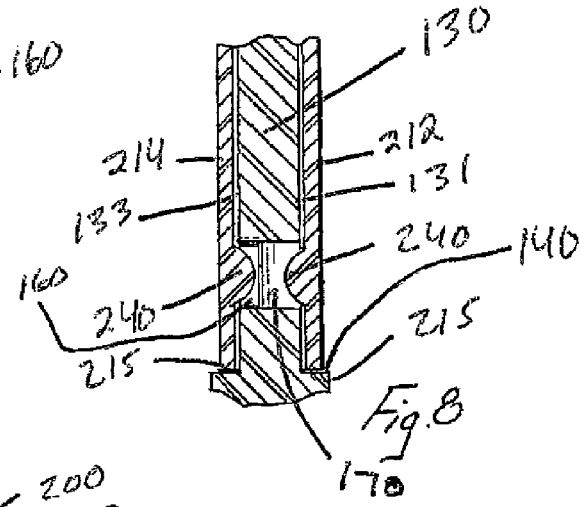
FIG. 8 is cross-sectional view taken along the line 8-8 of FIG. 7.

FIGS. 7 and 8 show the top sizer clip 200 in a locked position relative to the garment hanger 100. The top sizer clip 200 is driven toward the platform 140 until the locking tabs 240 engage and are received within the locking apertures 160 resulting in the top sizer clip 200 being securely attached to the garment hanger 100. In other words, the locking tabs 240 slide along the faces 131, 133 until the locking tabs 240 are received into the locking apertures 160. Upon being received within the locking apertures 160, the side walls 212, 214 flex inwardly toward one another since the interference created between the locking tabs 240 and faces 131, 133 is at least partially eliminated.

Figure 9:
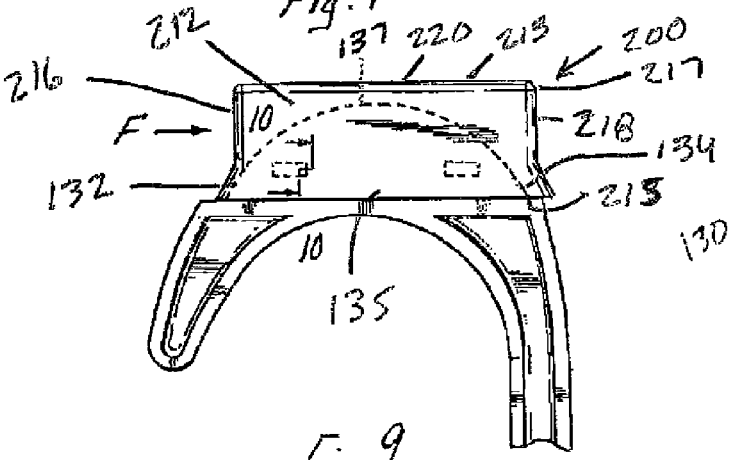
FIG. 9 is a side elevation view of the top sizer clip being moved to a release position on the garment hanger hook.

In this locked position, as shown in FIG. 9, the top sizer clip 200 is completely contained within the interior of the web 130. In other words, the ends 132, 134 of the web 130 are contained within the ends 216, 218 of the top sizer clip 200 and the top edge 137 of the web 130 is positioned below the top wall 220 of the top sizer clip 200. In addition, in the locked position, the end 134 of the web 130 is positioned close to the end 218 of the top sizer clip 200; however, the end 216 of the top sizer clip 200 is spaced slightly away from the end 132 due to the off-centered nature of the web 130 on the platform 140 (distance A being greater than distance B). However, in the locked position, there is still a smooth transition from the surfaces of the hook member 120 and the ends 216, 218 of the top sizer clip 200. In other words, the top sizer clip 200 covers the peripheral ledge 150 of the platform when it is in the locked position and a clean look is provided for the top sizer clip 200 on the hook member 120.

When the locking tabs 240 of the top sizer clip 200 engage the locking apertures 160, a snap-fit results between the top sizer clip 200 and the garment hanger 100. This results in the top sizer clip 200 being securely attached to the web 130 of the garment hanger in a manner in which removal of the top sizer clip 200 is difficult. In the locked position, the top sizer clip 200 is not intended to be removed since it is very difficult to get a fingernail underneath one side wall 212, 214 in order to lift the wall a sufficient distance in order to cause the locking tab 240 to clear the opening 160 and engage the respective face 131, 133.

In the locked position, the bottom edges 213, 215 are located proximate or in contact with the top surface of the platform 140 (the peripheral ledge 150 thereof).

Figure 10:
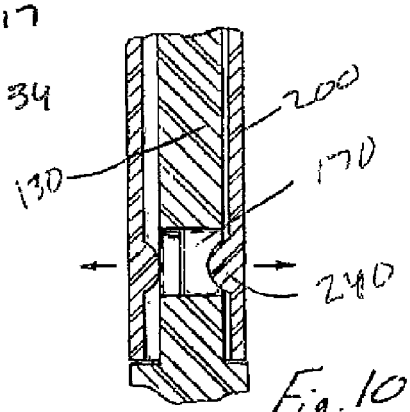
FIG. 10 is cross-sectional view taken along the line 10-10 of FIG. 9.

In accordance with the present invention, the web 130 has a clip unlocking or release feature (cam surfaces 170) that permits a locked top sizer clip 200 to be more easily removed from the web 130 when desired. The selective removal of the top sizer clip 200 is a two part process that is shown in FIGS. 9-12. First, as shown in FIGS. 9 and 10, the user laterally moves the top sizer clip 200 along the platform 140 to cause one pair of locking tabs 240 to encounter and begin riding up the inclined cam surfaces 170. As the top sizer clip 200 is continually advanced laterally along the platform 140, the pair of locking tabs 140 ride up the cam surfaces 170 toward the second ends 174 thereof as shown in FIGS. 9 and 10. This results in the side walls 212, 214 of the clip 200 flexing outwardly. It will be appreciated that the off-centered nature (distance A>distance B) of the web 130 permits the top sizer clip 200 to have a range of movement on the platform 140. If the web portion 130 was centered on the platform 140, the top sizer clip 200 would not have the necessary lateral movement to allow for the displacement of the locking tabs 240 from the locking apertures 160 and the disengagement of the top sizer clip 200 from the hook member 120.

Once the top sizer clip 200 is laterally moved along the platform 140 to cause the end 216 thereof to engage the end 132 of the web 130, the locking tabs 240 are located near or at the second ends 174 or actually and preferably are located along the first face 131 adjacent the cam surfaces 170. In other words, the distance A and the length of the ramp (distance from end 172 to end 174) are selected so that when the clip 200 is moved laterally along the platform 140 to a position where the ends 216, 132 are in contact, the locking tabs 240 have cleared the locking apertures 160. In this position, the top sizer clip 200 can be lifted upward as discussed below with reference to FIGS. 11 and 12. It will be appreciated that even in the position shown in FIG. 10, the top sizer clip 200 will not simply fall off the hanger 100 if inverted; however, the ease and degree of force necessary to remove the clip 200 are significantly improved compared to the ease and force needed to remove the clip 200 when it is in the fully locked position of FIG. 8. FIG. 10 thus shows an unlocked position where removal of the clip 200 is easier.

Figure 11:
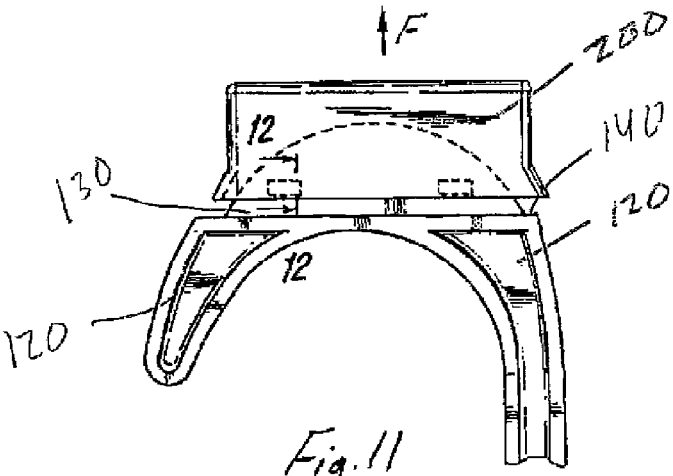
FIG. 11 is a side elevation view of the top sizer clip being removed from the garment hanger hook.
Figure 12:
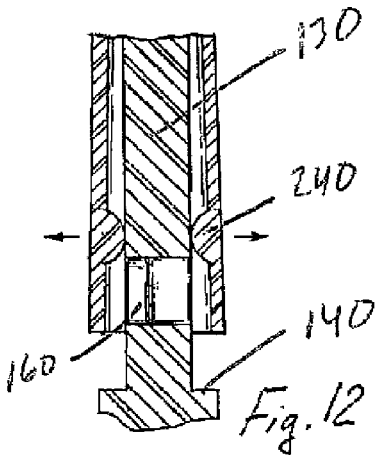
FIG. 12 is cross-sectional view taken along the line 12-12 of FIG. 11.

FIGS. 11 and 12 show the top sizer clip 200 being disengaged from the web 130 and in a position for easier removal of the top sizer clip 200 from the web 130. FIGS. 11 and 12 show the locking tabs 240 being seated against the faces 131, 133 outside of the apertures 160 and cam surfaces 170 as a result of the upward lifting of the top sizer clip 200 relative to the web 130. The top sizer clip 200 is lifted up and the locking tabs 240 ride along the faces 131, 133 until the top sizer clip 200 is completely lifted off of and removed from the web 130.

Because of the general resilient nature of the top sizer clip 200, especially, the side walls 212, 214, if the clip 200 is removed from the web 130 as described above, the side walls 212, 214 may resume, as least in part, their shape. This promotes reuse of the clip 200.

In addition, while a pair of cam surfaces 170 is shown, it will be appreciated that only a single cam surface 170 can be formed in the web 130. In this embodiment, one locking tab 240 engages the single cam surface 170 causing local separation of the clip walls 212, 214, thereby permitting disengagement of the top sizer clip 200 from the web portion 130.

Advantageously, a user can selectively remove the top sizer clip 200 from the web portion 130 by following a two step process, namely, a first step where the top sizer clip 200 is moved laterally relative to the web portion 130 (hook member 120) until an unlocking position is achieved and then a second step where the top sizer clip 200 is moved vertically relative to the web portion 130 to disengage the top sizer clip 200 from the hook member 120.

While exemplary drawings and specific embodiments of the present invention have been described and illustrated, it is to be understood that the scope of the present invention is not to be limited to the particular embodiments discussed. Thus, the embodiments shall be regarded as illustrative rather than restrictive, and it should be understood that variations may be made in those embodiments by workers skilled in the art without departing from the scope of the present invention as set forth in the claims that follow, and equivalents thereof. In addition, the features of the different claims set forth below may be combined in various ways in further accordance with the present invention.

What is claimed is:

1. A garment hanger for use with a top sizer clip that has at least one locking tab formed within an interior space thereof, the hanger comprising:

a body having a hook member including a web portion having a top portion and a pair of end portions and a platform extending at least partially around the web portion, the web portion having a first surface, an opposing second surface, and at least one locking aperture for receiving the locking tab to securely attach the top sizer clip to hanger, the locking aperture being completely bounded by the web portion and passing completely through the web portion, the web portion having at least one beveled cam surface that includes a first edge that defines an entrance into an adjacent locking aperture and an opposite second edge that is located closer to one end portion of the web and that interfaces with the first surface since the beveled surface lies in a plane that is different than a plane containing the first surface, the beveled cam surface being inclined toward the one end portion of the web for allowing lateral movement of the top sizer clip to thereby cause the locking tab to ride along the cam surface for moving the top sizer to an unlocking position.

2. The garment hanger of claim 1, wherein the web portion includes a pair of locking apertures for receiving a pair of locking tabs and a second beveled cam surface, each locking aperture having one associated beveled cam surface.

3. The garment hanger of claim 2, wherein the pair of apertures and the pair of cam surfaces are axially aligned and in a plane that is parallel to a plane that contains a top surface of the platform.

4. The garment hanger of claim 1, wherein the second surface is free of communication with the cam surface.

5. The garment hanger of claim 1, wherein portions of the first surface surrounding the locking aperture and the at least one cam surface is planar.

6. The garment hanger of claim 1, wherein the web portion is formed in an off-centered position along the platform, the web portion being offset in a lateral direction.

7. The garment hanger of claim 6, wherein the web portion has a semi-circular shape with one end portion of the web portion being spaced a first distance from a first end of the platform and the other end portion of the web portion being spaced a second distance from a second end of the platform, the first distance being greater than the second distance.

8. The garment hanger of claim 1, wherein the web portion extends perpendicularly upward from the platform, the dimensions of the web portion being less than dimensions of the platform so to create a ledge that extends around the web portion, the ledge for receiving a bottom edge of the top sizer clip.

9. A top sizer clip in combination with a hanger having a body and a hook member comprising:

a top sizer clip body having a pair of side walls and end walls joined to and extending between the side walls, the body including a top wall that is joined to upper edges of the side walls and end walls, the top wall partially enclosing the body so as to create a hollow body structure that includes an interior compartment defined by the end walls, side walls, and top wall, wherein an inner surface of each side wall includes a pair of locking tabs spaced apart from one another; and the hook member being coupled to a base section of the hanger body and including a web portion and a platform extending at least partially around the web portion, the web portion having a first surface, an opposing second surface, and first and second ends portions, the web portion further including a pair of locking apertures for receiving the locking tabs to securely attach the top sizer clip to hanger in a locked position which prevents removal of the top sizer clip from the hook member, each locking aperture being completely bounded by the web portion, the web portion having a pair of beveled cam surfaces accessible along the first surface, each beveled cam surface being inclined in a lateral direction toward the second end portion of the web portion, each beveled cam surface including a first edge that defines an entrance into the locking aperture and an opposite second edge that is closer to the second end portion and interfaces with the first surface and permits lateral movement of the top sizer clip on the web portion from the locked position to an unlocking position where the locking tab is displaced from the locking aperture by riding along the cam surface in the lateral direction.

10. The combination of claim 9, wherein the second surface is free of communication with the cam surface.

11. The combination of claim 9, wherein the web portion is formed in an off-centered position along the platform, the web portion being offset in a lateral direction.

12. The combination of claim 11, wherein the first end portion of the web portion is spaced a first distance from a first end of the platform and the second end portion of the web portion is spaced a second distance from a second end of the platform, the first distance being greater than the second distance.

13. The combination of claim 12, wherein the first distance and a length of the ramp from the first edge to the second edge thereof are selected so that when the top sizer clip is moved laterally along the platform, from the locked position, to a position where one end of the clip contacts the left edge of the web portion, the locking tab is displaced from the locking aperture by riding up along the cam surface to the unlocking position.

14. The combination of claim 9, wherein in the unlocking position, the locking tab is in intimate contact with the first surface adjacent the cam surface.

15. The garment hanger of claim 9, wherein the web portion extends perpendicularly upward from the platform, the dimensions of the web portion being less than dimensions of the platform so to create a ledge that extends around the web portion, the ledge for receiving a bottom edge of the top sizer clip.

16. A method for locking a top sizer clip on a hook member of a garment hanger and then selectively removing the locked top sizer clip from the garment hanger hook member comprising the steps of:

providing on the hook member a web portion and a platform extending at least partially around the web portion, the web portion having a first surface, an opposing second surface, and a pair of locking apertures;

forming a pair of beveled cam surfaces in the web portion, the cam surfaces being accessible along the first surface, each beveled cam surface including a first edge that defines an entrance into the locking aperture and an opposite second edge that interfaces with the first surface;

inserting the top sizer clip on the web portion such that the web portion is received into a hollow interior thereof, the top sizer clip having a pair of locking tabs formed along an inner surface of one side wall within the hollow interior, the locking tabs initially contacting the first surface of the web portion;

aligning the locking tabs with the locking apertures and directing the top sizer clip down along the first surface until the locking tabs are snap-lockingly received within respective locking apertures, thereby securely attaching the top sizer clip to the hook member in a locked position which prevents removal of the top sizer clip from the hook member; and selectively moving the top sizer clip to an unlocking position when it is desired to remove the top sizer clip by laterally moving the top sizer clip along the platform causing the locking tabs to encounter and ride up along corresponding cam surfaces resulting in outward separation of side walls of the top sizer clip, thereby permitting the top sizer clip to then be lifted upwardly and removed from the web portion as the locking tabs rides along the first surface outside of the locking apertures and the cam surfaces.

17. The method of claim 16, wherein the web portion is off-centered on the platform, with one end of the web portion being spaced a first distance from a first end of the platform and a second end of the web portion being spaced a second distance from a second end of the platform, the first distance being greater than the second distance, wherein the first distance and a length of each ramp from the first edge to the second edge thereof are selected so that during the step of laterally moving the top sizer clip along the platform, from the locked position, to a position where one end of the clip contacts the one end of the web portion, the locking tabs are displaced from the locking aperture by riding up along the cam surface to the unlocking position.

18. The method of claim 16, wherein the top sizer clip has a second pair of locking tabs formed along an inner surface of an opposite side wall within the hollow interior, the second pair of locking tabs contacting the second surface of the web portion, and wherein during the step of laterally moving the top sizer clip, the second pair of tabs are displaced from the locking apertures directly onto the second surface without riding along any cam surfaces.

* * * * *